US005231750A

United States Patent [19]

Fealey

[11] Patent Number: 5,231,750

[45] Date of Patent: Aug. 3, 1993

[54] FASTENER DRIVING DEVICE WITH OFFSET FEED

[75] Inventor: William S. Fealey, Jamestown, R.I.

[73] Assignee: Stanley-Bostitch Inc., East Greenwich, R.I.

[21] Appl. No.: 962,347

[22] Filed: Oct. 16, 1992

[51] Int. Cl.[5] ..... B25C 1/04

[52] U.S. Cl. ..... 29/432; 29/525.1; 227/130; 227/136; 92/140; 92/165 R; 173/127

[58] Field of Search ..... 227/10, 120, 123, 130, 227/135, 136; 29/525.1, 432, 813; 92/140, 165 R; 173/127, 206

[56] References Cited

U.S. PATENT DOCUMENTS

| | | | |
|---|---|---|---|
| 3,083,369 | 4/1963 | Peterson | 206/345 |
| 3,301,456 | 1/1967 | Schafroth et al. | 227/130 X |
| 3,606,128 | 9/1971 | Cast et al. | 227/130 X |
| 3,708,095 | 1/1973 | Briggs, Jr. | 227/126 |
| 3,820,705 | 6/1974 | Beals | 227/120 X |
| 3,902,238 | 9/1975 | Monson | 29/432 |
| 3,915,242 | 10/1975 | Bell | 173/206 |
| 3,935,945 | 2/1976 | Smith et al. | 206/343 |
| 4,784,306 | 11/1988 | Baum | 227/130 X |
| 4,832,245 | 5/1989 | Terayama et al. | 227/130 |

FOREIGN PATENT DOCUMENTS

| | | | |
|---|---|---|---|
| 826301 | 12/1951 | Fed. Rep. of Germany | 92/140 |
| 2529873 | 1/1977 | Fed. Rep. of Germany | 227/130 |
| 1239097 | 10/1959 | France | 92/140 |
| 1486174 | 5/1967 | France | 173/127 |

*Primary Examiner*—Frank T. Yost

*Assistant Examiner*—Clark F. Dexter

*Attorney, Agent, or Firm*—Cushman, Darby & Cushman

[57] ABSTRACT

A fluid pressure operated nailer is provided including a portable housing having a fixed generally longitudinally extending chamber axis, a fluid pressure actuated mechanism mounted in the housing for movement through successive operative cycles. The nailer includes an elongated nail driving element having a nail engaging end, an opposite end and a longitudinal driver axis extending therebetween. A housing nosepiece is provided which includes surfaces defining a leading nail containing space wherein a nail axis of the leading nail is laterally spaced with respect to the fixed chamber axis. The nosepiece includes surfaces defining a nail feed track extending to the leading nail containing space for guiding a releasably interconnected supply of nails engaged therewith along the nail feed track for generally longitudinal movement therefrom. The nosepiece also includes a lateral moving assembly for causing the nail engaging end of the nail driving element during an initial portion of the drive stroke to engage the leading nail in the nail separating position with the driver axis at the nail engaging end thereof spaced laterally from the chamber axis, and during an intermediate portion of the drive stroke to move laterally with the leading nail engaged thereby and moved therewith until the driver axis and nail axis are generally aligned with the chamber axis. During a final portion of the drive stroke, the engaging end of said nail driving element remains with the driver axis and nail axis generally aligned with the chamber axis, until the nail is driven into a workpiece.

13 Claims, 4 Drawing Sheets

FASTENER DRIVING DEVICE WITH OFFSET FEED

This invention relates to fastener driving devices and more particularly to portable power operated devices of the type for driving nails, particularly nails collated together in stick formation with their heads in overlapping relation.

A nail stick is similar to a staple stick in that a multiplicity of similarly oriented fasteners are collated in an aligned row and suitably adhered together. The existence of a head which normally extends outwardly from the shank in all directions prevents collation in a straight abutting row. As indicated in commonly assigned U.S. Pat. No. 3,083,369, without a modification of the head, the densest row that can be formed with similarly oriented nails is to fan out the nails in an abutting row with the pointed ends engaged and the heads in lapped relation as shown in FIG. 6 of the '369 patent. FIG. 8 of the '369 patent illustrates another possible row formation wherein the heads are lapped and the shanks are parallel. By notching the heads, the shanks need no longer be fanned out or spaced apart but instead can be brought into substantially full abutting relation. The result is a nail stick which, due to the overlapping head portions, extends in a row which is angular rather than perpendicular with respect to the axis of the shanks. See, for example, the notched head nail stick disclosed in commonly assigned U.S. Pat. No. 3,935,945. D-head nails may also be used to form nail sticks of this type.

When mounted in a nailer magazine, the leading nail of the nail stick has at least the trailing portion of its head overlapped by the leading portion of the head of the adjacent nail. This lapped relationship prevents the nailer from having a drive track of a circular cross-sectional configuration suitable to permit a circular nail head to pass therethrough within which a comparably shaped fastener driving element is slidably mounted. This is because such a driver would engage the overlapping portion of the second nail head of the leading nail head if the leading nail is allowed to be moved fully into the drive track. The result is that because the full round drive track must be modified to provide a surface or surfaces therein to engage the head or shank of the leading nail to limit the extent to which it can move forwardly along the feed track into the drive track, it is not possible to use a full round nail driver. Moreover, if the diameter of the nail driver is simply reduced in diameter sufficiently to clear both the leading nail head stop and the head overlapping the leading nail head, insufficient strength is provided. The result is that the cross-section of the nail driver must be provided with ribs or flanges which extend beyond the periphery of the ideal circular drive track for accommodating nail movement therein. See, for example, commonly assigned U.S. Pat. No. 3,708,095. As shown in the '095 patent, cam surfaces are provided for engaging the leading nail head during the initial portion of its movement by the nail driver to move the nail head forwardly into better alignment with the drive track axis.

It has also been the practice heretofore to control rearward movement of the leading nail being driven by engagement with the shank of the second nail which is spring urged forwardly by the magazine pusher. As the nail driver moves through its drive stroke, the forward bias of the second nail is increasingly resisted by the nail driver itself which continues in biased sliding engagement therewith through a major portion of the return stroke of the nail driver until the lower end clears the head of the now leading nail in the feed track to allow the pusher to move it into its separating position.

Because of this resilient manner of controlling the rearward movement of the nail in the drive track, it was sometimes the case that rearward movement occurred. The frequency of rearward movement significantly increased when screw nails were utilized to form the nail stick. A screw nail is formed with a spirally fluted shank which imparts a rotational movement to the nail about its axis as it is driven longitudinally. With a spirally fluted shank, the normal line contact between the shanks of the leading nail and the second nail becomes point contact. Moreover, since the nail turns on its axis as it is driven, the periphery of the head acts as a cam to effect rearward movement rather than a grooved guide.

The structural arrangement which results from all of these interrelationships is a drive track which is considerably more complex than a simple cylindrical bore of a size suitable to accommodate the nail head and a fastener driving element considerably more complex than a simple cylindrical rod. This complexity adds to the cost of the tool and compromises to some extent the control of the nail during the driving operation. There exists a need for a nailer which will obviate these disadvantages and accomplish the nail driving operation in a more cost effective manner.

An object of the present invention is to fulfill the need expressed above. In accordance with the principles of the present invention, this objective is accomplished by providing a fluid pressure operated nailer comprising a portable housing including a main body portion defining a fluid pressure chamber having a fixed generally longitudinally extending chamber axis. A fluid pressure actuated piston is mounted in the fluid pressure chamber for movement through successive operative cycles each including a drive stroke in one direction along the chamber axis by the application of fluid pressure therewith and a return stroke in an opposite direction along the chamber axis. An elongated nail driving element is provided which has a nail engaging end, an opposite end and a longitudinal driver axis extending therebetween. The opposite end of the nail driving element is connected with the piston for movement therewith so that the nail driving element will be moved through successive cycles each including drive and return strokes with the piston. A housing nosepiece and magazine assembly is provided which includes surfaces defining a leading nail containing space for containing a leading nail in a nail separating position therein wherein a nail axis of the leading nail is laterally spaced with respect to the fixed chamber axis. The nosepiece and magazine assembly includes surfaces defining a nail feed track extending to the leading nail containing space for guiding a releasably interconnected supply of nails engaged therewith along the nail feed track so that a leading nail of the supply can be supported in the nail separating position for generally longitudinal movement therefrom. The nosepiece and magazine assembly include a mechanism for causing the nail engaging end of the nail driving element (1) during an initial portion of the drive stroke of the nail driving element to engage the head of a leading nail in the nail separating position with the driver axis at the nail engaging end thereof spaced laterally from the chamber axis, and (2) during an intermediate portion of the drive stroke of the nail driving element to move laterally with the head of the nail engaged thereby and moved therewith until the driver axis and nail axis are generally aligned with the chamber axis. During a final portion of the drive stroke of the nail driving element, the engaging end of the nail driving element remains with the driver axis and nail axis generally aligned with the chamber axis until the nail is driven into a workpiece.

Another object of the present invention is the provision of a fluid pressure operated nailer of the type described which is simple in construction, effective in operation and economical to manufacture and maintain.

These and other objects of the present invention will become more apparent during the course of the following detailed description and appended claims.

The invention may be best understood with reference to the accompanying drawings wherein an illustrative embodiment is shown.

BRIEF DESCRIPTIONS OF THE DRAWINGS

Figure 1:
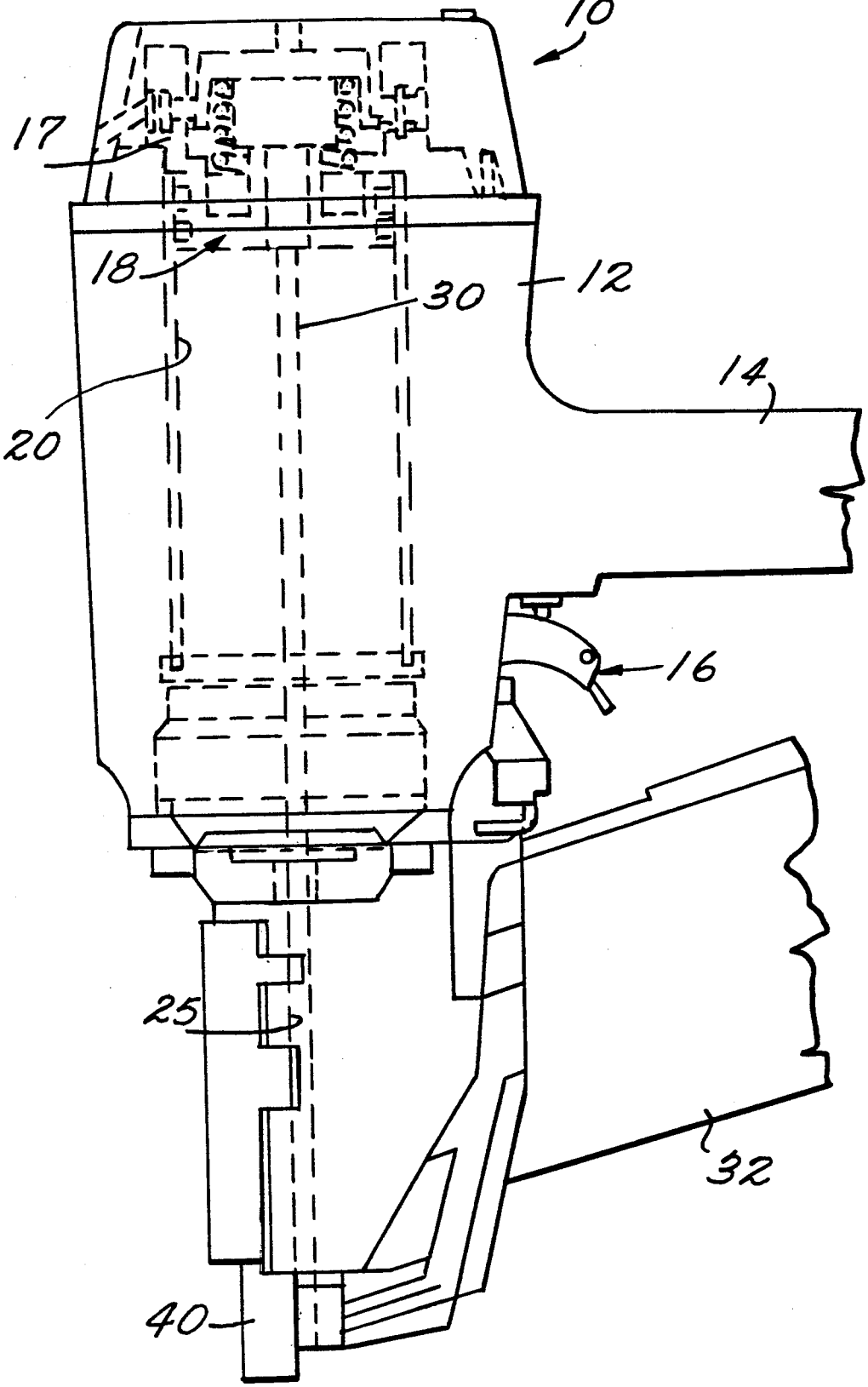
FIG. 1 is a side elevational view of a portable fastener driving device showing the piston and fastener driving element embodying the principles of the present invention in dotted lines within the cylinder and nosepiece assembly of the device.

Referring now more particularly to FIG. 1, there is shown therein a portable pneumatically operated fastener driving device in the form of a portable tool, generally indicated at 10, which embodies the principles of the present invention. As shown, the tool 10 includes a portable housing 12 having a hollow handle 14 defining a reservoir connected to a source of compressed air. The device includes a trigger actuated valve mechanism, generally indicated at 16 including a contact trip 40, for supplying the compressed air within the reservoir to a pilot pressure chamber of a main valve mechanism 17. The contact trip 40 permits the trigger to function when depressed against a work surface. The main valve mechanism, when moved from its normally biased closed position into an open position, communicates the reservoir with a fluid pressure actuated mechanism, generally indicated at 18, which is mounted for movement within a fluid pressure chamber 20.

Figure 2:
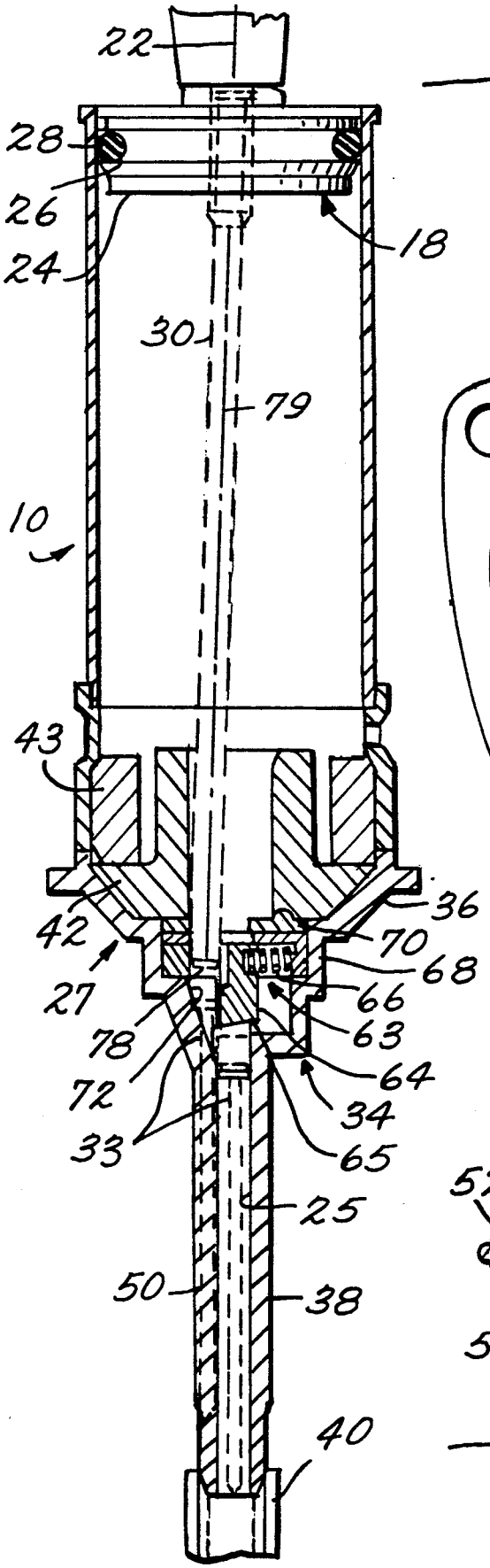
FIG. 2 is a front sectional view of a fluid pressure operated nailer embodying the principles of the present invention shown with the housing assembly removed and the lateral biasing mechanism clearly visible.

The reservoir surrounds the upper portion of the fluid pressure chamber 20 and the upper end of the pressure chamber 20 is closed by the main valve mechanism 17 when in its normally biased closed position. The fluid pressure chamber 20 is of generally cylindrical configuration and has a fixed, generally longitudinally extending chamber axis 22. The fluid pressure actuated mechanism 18 is mounted in the fluid pressure chamber 20 for movement through successive operative cycles, each including a drive stroke in one direction along the chamber axis 22 by the application of fluid pressure therewith and a return stroke in an opposite direction along the chamber axis 22. As shown in FIG. 2, the fluid pressure actuated mechanism 18 includes a driving piston 24 which is slidably sealingly mounted with in the chamber 20. The driving piston 24 includes a groove 26 disposed in the periphery thereof to receive a suitable O-ring seal 28 lubricated by lubricant conventionally supplied to the air pressure supply line. The piston 24 is sealingly mounted so as to permit limited tilting movement thereof. A fastener driving element 30 is fixed at one end thereof to the driving piston 24 and extends within a nosepiece assembly, generally indicated at 27. The opposite end of the driving element 30 is adapted to engage a nail. The driving element 30 moves with the piston through successive cycles, each including drive and return strokes. The nosepiece assembly 27 further includes a drive track 25. In the typical device 10, shown, a magazine assembly 32 is provided for feeding successive leading fasteners into a separating position containing a laterally offset nail in a nail containing space to be driven by the fastener driving element 30 initially into a drive track and outwardly thereof into a workpiece during the drive stroke of the piston 24, which will become more apparent below.

The fastener packages utilized with the tool are preferably of the conventional type wherein the leading nail 33 in the nail stick has at least the trailing portion of its head overlapped by the leading portion of the head of an adjacent nail.

The nosepiece assembly 27 includes a rigid nosepiece member, generally indicated at 34, which includes an upper portion 36 which is suitably fixed to the lower portion of chamber 20. The nosepiece member also includes a forward central depending portion 38 which is bored to define the drive track 25. The discharge end of the forward central portion 38 is of tubular form and is adapted to receive a conventional contact trip member 40 connected thereto. The contact trip 40 is formed to envelope the tubular end which defines the discharge end of the drive track 25.

Figure 7:
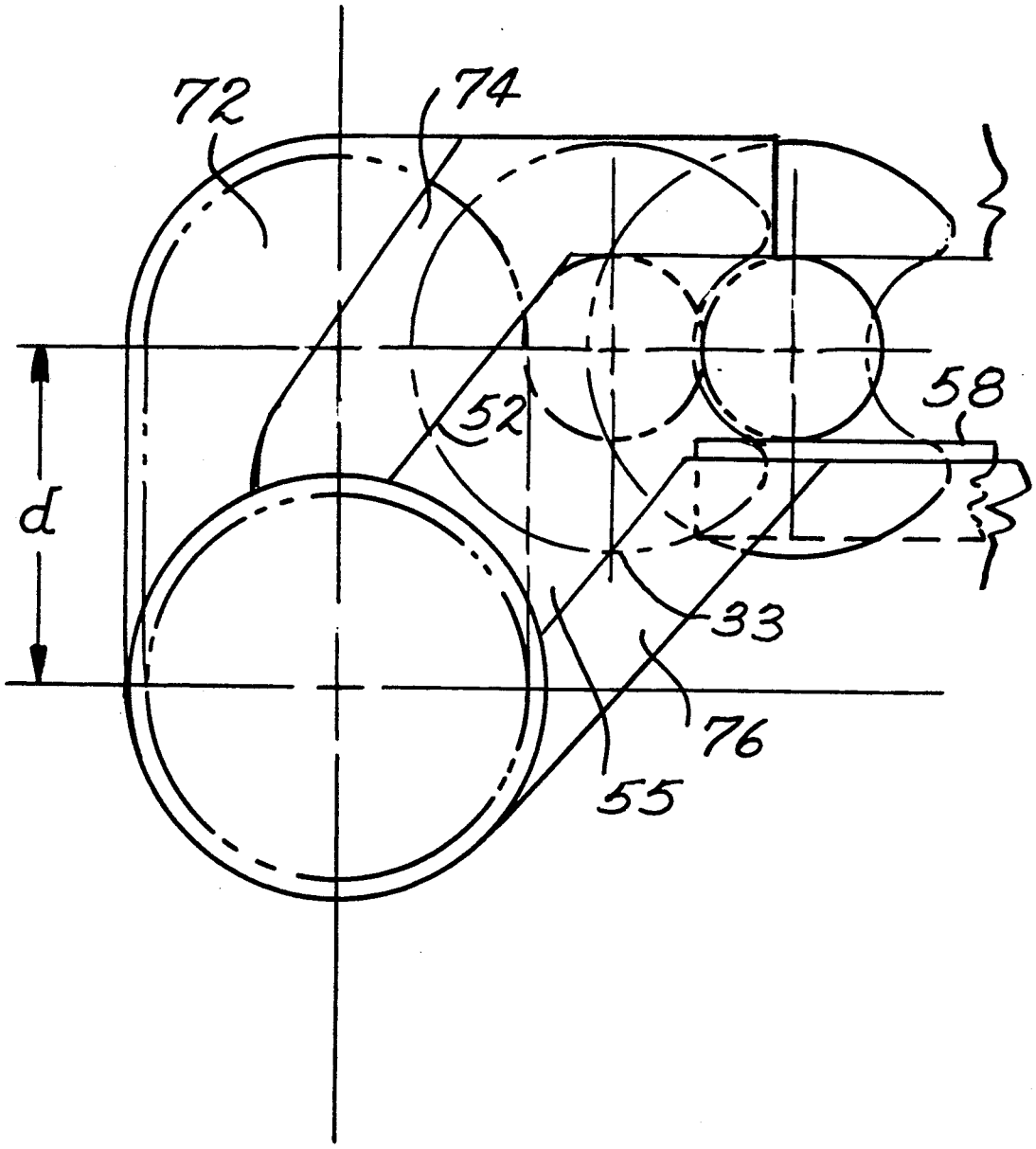
FIG. 7 is a partial enlarged top plan view of the nosepiece assembly.

The upper portion 36 of the nosepiece 27 includes resilient bumper members 42, 43 engageable by piston 24 when it reaches the end of its drive stroke. The nosepiece member 34 includes a rearward portion 44 extending rearwardly of the drive track 25. The rearward portion 44 includes a vertically extending surface 46 intersecting with the surface defining a nail feed track 48. The nail feed track 48 defines an upwardly facing inclined surface which is adapted to engage the heads of a releasably interconnected supply of nails to support the same so that their shanks extend along vertical surface 46. The nail feed track 48 extends to a leading nail containing space 50 defined by surface 52 for containing a leading nail 33 in a nail separating position therein. The nail axis 54 is laterally offset from the chamber axis 22. In the illustrated embodiment as shown in FIG. 7, the lateral offset distance (d) is approximately 0.25 inches. The forward central portion 38 includes a ramp portion 55 to assist in guiding the nail points into the drive track 25, if, for any reason the point of the nail does not advance into the drive track during an intermediate portion of the drive stroke, which will become more apparent below.

Figure 4:
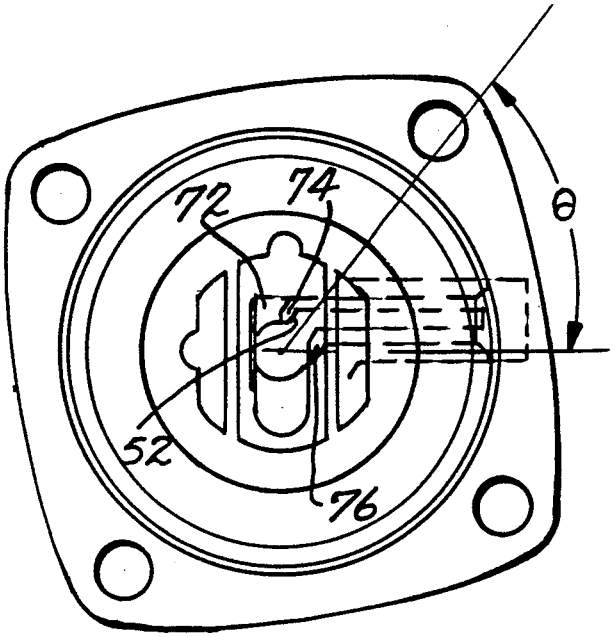
FIG. 4 is a top plan view of the nosepiece assembly of FIG. 3.
Figure 6:
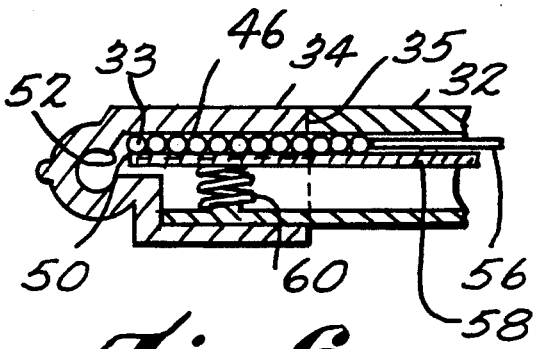
FIG. 6 is a sectional view taken along line VI—VI of FIG. 3 with a conventional magazine assembly attached to a surface of the nose assembly.
Figure 3:
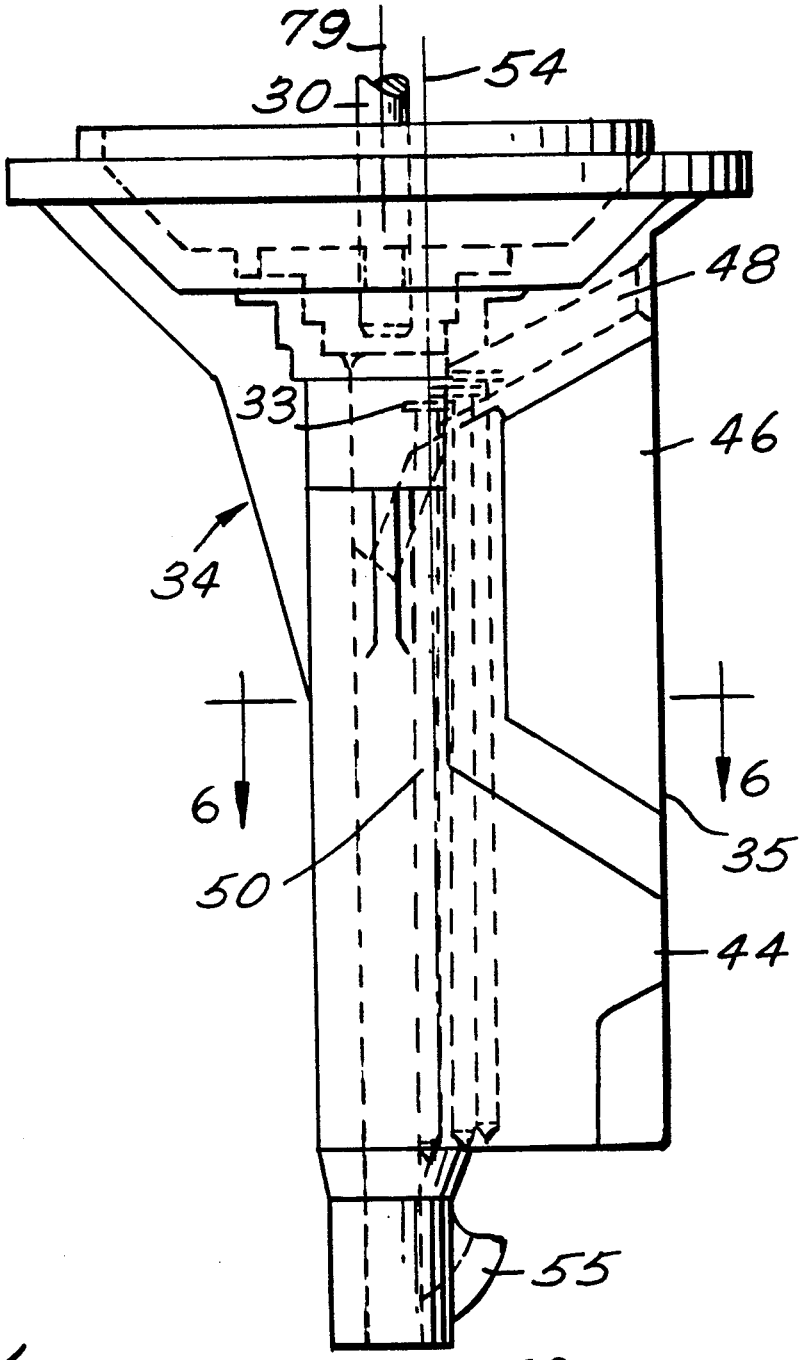
FIG. 3 is a side elevational view of the nosepiece assembly with the lateral biasing mechanism and magazine assembly removed for clarity.
Figure 5:
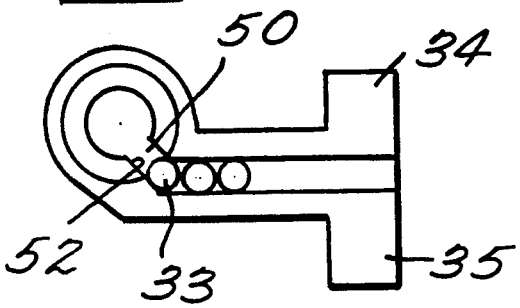
FIG. 5 is a bottom plan view of the nosepiece assembly of FIG. 3 with the ramp portion removed for clarity.

As shown in FIG. 6 the magazine assembly 32 is mated to the nosepiece member 34 at surface 35 so as to supply interconnected nails to the nail feed track 48. The magazine assembly includes a spring-biased pusher member 56 which forces the leading nail 33 until it is stopped at surface 52, in a nail separating position, in the nail containing space 50. The magazine assembly 32 further includes a pressure plate 58 biased by spring 60, which forces the interconnected nails against surface 46 of the nose member 34. As shown in FIG. 4, the nails enter the nail containing space at an angle Θ which, in the illustrated embodiment, is approximately 52 degrees.

Referring to FIG. 2, the nosepiece member 34 includes a lateral biasing mechanism, generally indicated at 63. The lateral biasing mechanism 63 includes a guide 64 mounted in a guide housing 68 adjacent the pressure chamber 20 for lateral movement in opposite directions and a spring element 66 coupled at one end thereof to the guide 64 for biasing the guide in one direction. The other end of the spring element 66 is coupled to guide housing 68, which is affixed to the nosepiece member 34. A cover plate 70 is disposed between the guide housing 68 and bumper 42. The guide 64 is adapted to slidably receive the fastener driving element 30 so as to bias the fastener driving element laterally. Camming surfaces 74 and 76 (FIG. 4) bring the leading nail 33 from an offset nail axis 54 to the chamber axis 22 after the nail is cut off by the driving element 30. The nosepiece member 34 further includes a fixed camming surface 72 (FIGS. 2 and 4) which brings the fastener driving element back to the chamber axis after the leading nail 33 is cut off, which will become more apparent below. Guide 64 includes a leg portion 65 which serves to block the driving track 25 when the driving element is in the offset nail separating position as shown in FIG. 2. This prevents an object from being inadvertently inserted into the driving track 25 and wedged between the tip of the driving element and the adjacent surfaces of the nosepiece member.

The operation of the fastener driving device 10 will be appreciated below. The operator first moves the device so that the contact trip member 40 is in cooperating position with the workpiece which is to receive the fastener. Next, the operator digitally effects movement of the trigger valve mechanism 16 from its normal inoperative position into the operative position thereof. The actuation of the trigger valve supplies compressed air to the pilot pressure chamber of the main valve mechanism 17. The pilot pressure acts on the main valve mechanism 17 to move the same to its open position which initiates the drive stroke of the fastener driving element 30. During an initial portion of the drive stroke of the fastener driving element 30, the lateral biasing mechanism 63 and camming surfaces 72, 74 and 76 cause the fastener engaging end 78 of the fastener driving element 30 to engage the head of the leading nail 33 which is disposed in the nail containing space 50, with the driving element axis 79 at the fastener engaging end thereof being spaced laterally from the chamber axis 22.

During an intermediate portion of the drive stroke, the lateral biasing mechanism 63 and camming surface 72 cause the engaging end 78 of the fastener driving element 30 to move laterally with the head of the nail 33 engaged thereby and moved therewith until the driving element axis 79 and the nail axis 54 are generally aligned with the chamber axis 22. This movement cuts-off the leading nail 33 of the interconnected supply of nails. Thus, in this intermediate portion of the drive stroke, the fastener driving end 78 is moved laterally against the bias of spring element 66. After the nail is cut-off, camming surfaces 74, 76 bring the nail to the chamber axis 22.

During a final portion of the drive stroke of the fastener driving element 30, the drive track 25 causes the fastener driving element 30 axis 79 and nail axis 54 to remain in general alignment with each other and with the chamber axis 22, until the nail 33 is driven into a workpiece.

During the stroke portion of the fastener driving element 30, the next adjacent nail is fed into the nail containing space 50 by the magazine assembly 32 to be later cut-off and driven into the workpiece by the driving element 30. The lateral biasing mechanism 63 is operable to enable the fastener driving element 30 to remain with the driving element axis 79 generally aligned with the chamber axis 22 during an initial portion of the return stroke, substantially equal to the intermediate and final portions of the drive stroke, enabling the leading nail 33 to be moved into the nail containing space 50 and in a nail separating position when the fastener driving element is moving through the stroke portions when the driving element axis 79 is generally aligned with the chamber axis 22.

The nail containing space 50 is sufficiently offset from the chamber axis 22 to accommodate movement of the nail 33 into a separating position, when the fastener driving element 30 is disposed with the driving element axis 79 generally aligned with the chamber axis 22.

It can be appreciated that the nail driver of the present invention offers many advantages over conventional devices. For example, the driving element bore and driving element can be made completely round, which reduces manufacturing costs and permits the use of full-round headed nails disposed in a pitched collation. In addition, the driven nail cannot kick back toward the magazine. Also, the magazine pusher cannot be hit by the driving element.

Other advantages of the present invention include the feature that the nails and pusher do not feed against the driving element in the return stroke. Also, additional parts are not required to shuttle the driving element and nail from an offset, cutoff position to the chamber axis. The nosepiece alone, which traditionally guides the nails from an in-line feed, continues to provide this function to the offset feed and, along a separate path, guides the driving element. The nail driving element of the present invention permits operating speed to be increased since nail feeding occurs during the drive and return stroke. Nail feed does not need to wait for the driving element to return, thus, increasing operating speed, since feed speed is typically the limiting factor in overall cycle speed.

It will be appreciated that the nosepiece member having the lateral biasing mechanism and camming surfaces may be fed by many different magazine assemblies. For example, nails interconnected by wires may be fed into the nosepiece to be cut-off by the driving element.

It thus will be appreciated that the objects of this invention have been fully and effectively accomplished. It will be realized, however, that the foregoing preferred embodiment of the present invention has been shown and described for the purposes of illustrating the structural and functional principles of the invention and is subject to change without departure from such principles. Therefore, this invention includes all modifications encompassed within the spirit of the following claims.

What is claimed is:

1. A fluid pressure operated nailer comprising:

a portable housing including a main body portion defining fluid pressure chamber structure having a fixed generally longitudinally extending chamber axis, fluid pressure actuated mechanism mounted in said fluid pressure chamber structure for movement through successive operative cycles each including a drive stroke in one direction along said chamber axis by the application of fluid pressure therewith and a return stroke in an opposite direction along said chamber axis, an elongated nail driving element having a nail engaging end, an opposite end and a longitudinal driver axis extending therebetween, a member for connecting the opposite end of said nail driving element with said fluid pressure actuated mechanism for movement therewith so that said nail driving element will be moved through successive cycles each including drive and return strokes with said fluid pressure actuated mechanism, a housing nosepiece and magazine assembly including surfaces defining a leading nail containing space for containing a leading nail in a nail separating position therein wherein a nail axis of the leading nail is laterally spaced with respect to the fixed chamber axis, said nosepiece and magazine assembly including surfaces defining a nail feed track extending to said leading nail containing space for guiding a releasably interconnected supply of nails engaged therewith along the nail feed track so that a leading nail of the supply can be supported in said nail separating position for generally longitudinal movement therefrom, said nosepiece and magazine assembly including a lateral biasing mechanism and camming surfaces for causing the nail engaging end of said nail driving element during an initial portion of the drive stroke of said nail driving element to engage the head of said leading nail in said nail separating position with the driver axis at the nail engaging end thereof spaced laterally from the chamber axis, during an intermediate portion of the drive stroke of said nail driving element to move laterally with the head of the leading nail engaged thereby and moved therewith until the driver axis and nail axis are generally aligned with the chamber axis, and during a final portion of the drive stroke of the nail driving element, said engaging end of said nail driving element remains with the driver axis and nail axis generally aligned with the chamber axis, until the nail is driven into a workpiece.

2. A fluid pressure operated nailer as defined in claim 1 wherein said fluid pressure actuated mechanism includes a piston slidably sealingly mounted within said chamber structure for limited tilting movement in sealing relation therewith, said connecting member comprising a fixed connection between said opposite end of said nail driving element and said piston.

3. A fluid pressure operated nailer as defined in claim 2 wherein said lateral biasing mechanism includes a guide mounted in said nosepiece and magazine assembly adjacent said chamber structure for lateral movement in opposite directions and a spring element for biasing said guide in one direction, said guide slidably receiving said nail driving element so as to bias said nail driving element laterally, said guide cooperating with said camming surfaces for engaging the nail driving end of said nail driving element and the nail head engaged thereby during said intermediate portion of the drive stroke of the nail driving element so as to move the nail driving end thereof laterally against the bias of said spring element.

4. A fluid pressure operated nailer as defined in claim 3 wherein said leading nail containing space is sufficiently laterally offset from said chamber axis to accommodate the movement of a nail into said nail separating position when said nail driving element is disposed with the driver axis generally aligned with said chamber axis.

5. A fluid pressure operated nailer as defined in claim 4 wherein said lateral biasing mechanism and said camming surfaces cooperate to enable said nail driving element to remain with the driver axis generally aligned with the chamber axis during an initial portion of the return stroke substantially equal to the intermediate and final portions of the drive stroke enabling a next leading nail to be moved into said nail separating position when said nail driving element is moving through the stroke portions when the driver axis is generally aligned with said chamber axis.

6. A fluid pressure operated nailer as defined in claim 1 wherein said nosepiece and magazine assembly includes a mechanism for feeding the supply of nails engaged with said feed track along said feed track so as to move a next leading nail into said nail separating position during the movement of said nail driving element through the final portion of the drive stroke thereof.

7. A method of driving a nail into a workpiece with the use of a fastener driving device, the fastener driving device including a portable housing including a main body portion defining fluid pressure chamber structure having a fixed generally longitudinally extending chamber axis, a fluid pressure actuated mechanism mounted in said fluid pressure chamber structure for movement through successive operative cycles each including a drive stroke in one direction along said chamber axis by the application of fluid pressure therewith and a return stroke in an opposite direction along said chamber axis, an elongated nail driving element having a nail engaging end, an opposite end and a longitudinal driver axis extending therebetween, a member for connecting the opposite end of said nail driving element with said fluid pressure actuated mechanism for movement therewith so that said nail driving element will be moved through successive cycles each including drive and return strokes with said fluid pressure actuated mechanism, a housing nosepiece and magazine assembly including surfaces defining a leading nail containing space for containing a leading nail in a nail separating position therein wherein a nail axis of the leading nail is laterally spaced with respect to the fixed chamber axis, said nosepiece and magazine assembly including surfaces defining a nail feed track extending to said leading nail containing space for guiding a releasably interconnected supply of nails engaged therewith along the nail feed track, said method comprising the steps of:

supporting a leading nail of the supply in said nail separating position for generally longitudinal movement from said nail feed track, engaging the leading nail with the nail engaging end of the nail driving element during an initial portion of the drive stroke of said nail driving element with the leading nail in said nail separating position, the driver axis at the nail engaging end thereof being spaced laterally from the chamber axis during said initial portion of the drive stroke of said nail driving element, laterally moving the leading nail and the nail driving element during an intermediate portion of the drive stroke of said nail driving element with the driver axis and nail axis being generally aligned with the chamber axis, and permitting said nail driving element to remain with the driver axis and nail axis generally aligned with the chamber axis until the nail is driven into a workpiece, during a final portion of the drive stroke of the nail driving element.

8. A fluid pressure operated nailer comprising:

a portable housing including a main body portion defining fluid pressure chamber means having a fixed generally longitudinally extending chamber axis, fluid pressure actuated means mounted in said fluid pressure chamber structure for movement through successive operative cycles each including a drive stroke in one direction along said chamber axis by the application of fluid pressure therewith and a return stroke in an opposite direction along said chamber axis, an elongated nail driving element having a nail engaging end, an opposite end and a longitudinal driver axis extending therebetween, means for connecting the opposite end of said nail driving element with said fluid pressure actuated means for movement therewith so that said nail driving element will be moved through successive cycles each including drive and return strokes with said fluid pressure actuated means, a housing nosepiece and magazine assembly including surface means defining a leading nail containing space for containing a leading nail in a nail separating position therein wherein a nail axis of the leading nail is laterally spaced with respect to the fixed chamber axis, said nosepiece and magazine assembly including surfaces defining a nail feed track extending to said leading nail containing space for guiding a releasably interconnected supply of nails engaged therewith along the nail feed track so that a leading nail of the supply can be supported in said nail separating position for generally longitudinal movement therefrom, said nosepiece and magazine assembly including a lateral moving means for causing the nail engaging end of said nail driving element during an initial portion of the drive stroke of said nail driving element to engage the head of said leading nail in said nail separating position with the driver axis at the nail engaging end thereof spaced laterally from the chamber axis, during an inter nediate portion of the drive stroke of said nail driving element to move laterally with the head of the leading nail engaged thereby and moved therewith until the driver axis and nail axis are generally aligned with the chamber axis, and during a final portion of the drive stroke of the nail driving element, said engaging end of said nail driving element remains with the driver axis and nail axis generally aligned with the chamber axis, until the nail is driven into a workpiece.

9. A fluid pressure operated nailer as defined in claim 8 wherein said fluid pressure actuated means includes a piston slidably sealingly mounted within said chamber means for limited tilting movement in sealing relation therewith, said connecting means comprising a fixed connection between said opposite end of said nail driving element and said piston.

10. A fluid pressure operated nailer as defined in claim 9 wherein said lateral moving means includes a guide mounted in said nosepiece and magazine assembly adjacent said chamber means for lateral movement in opposite directions and spring means for biasing said guide in one direction, said guide slidably receiving said nail driving element so as to bias said nail driving element laterally and fixed camming surfaces for engaging the nail driving end of said nail driving element and the nail head engaged thereby during said intermediate portion of the drive stroke of the nail driving element so as to move the nail driving end thereof laterally against the bias of said spring means.

11. A fluid pressure operated nailer as defined in claim 10 wherein said leading nail containing space is sufficiently laterally offset from said chamber axis to accommodate the movement of a nail into said nail separating position when said nail driving element is disposed with the driver axis generally aligned with said chamber axis.

12. A fluid pressure operated nailer as defined in claim 11 wherein said lateral moving means is operable to enable said nail driving element to remain with the driver axis generally aligned with the chamber axis during an initial portion of the return stroke substantially equal to the intermediate and final portions of the drive stroke enabling a next leading nail to be moved into said nail separating position when said nail driving element is moving through the stroke portions when the driver axis is generally aligned with said chamber axis.

13. A fluid pressure operated nailer as defined in claim 8 wherein the nosepiece and magazine assembly includes means for feeding the supply of nails engaged with said feed track along said feed track so as to move a next leading nail into said nail separating position during the movement of said nail driving element through the final portion of the drive stroke thereof.

* * * * *